US009004930B2

(12) United States Patent
Gualino et al.

(10) Patent No.: US 9,004,930 B2
(45) Date of Patent: Apr. 14, 2015

(54) ELECTRICAL CONNECTOR ASSEMBLY

(75) Inventors: David Gualino, Saint Ismier (FR); Rachid Makhlouche, Grenoble (FR); Charles Blondel, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 85 days.

(21) Appl. No.: 13/883,868

(22) PCT Filed: Aug. 11, 2011

(86) PCT No.: PCT/FR2011/000464

§ 371 (c)(1), (2), (4) Date: Jul. 25, 2013

(87) PCT Pub. No.: WO2012/032230

PCT Pub. Date: Mar. 15, 2012

(65) Prior Publication Data

US 2013/0295781 A1 Nov. 7, 2013

(30) Foreign Application Priority Data

Sep. 7, 2010 (FR) ..... 10 03562

(51) Int. Cl.

| | |
|---|---|
| ***H01R 13/44*** | (2006.01) |
| ***H01R 13/62*** | (2006.01) |
| ***H01R 13/24*** | (2006.01) |
| ***H01R 13/453*** | (2006.01) |

(52) U.S. Cl.

CPC ..... *H01R 13/6205* (2013.01); *H01R 13/2421* (2013.01); *H01R 13/4538* (2013.01)

(58) Field of Classification Search

USPC ..... 439/39, 136, 138, 142, 289, 310

See application file for complete search history.

(56) References Cited

U.S. PATENT DOCUMENTS

| | | | | |
|---|---|---|---|---|
| 1,579,865 | A * | 4/1926 | Hubbell | 439/138 |
| 3,521,216 | A | 7/1970 | Tolegian | |
| 5,372,515 | A | 12/1994 | Miller et al. | |
| 5,716,224 | A * | 2/1998 | Masuda et al. | 439/138 |
| 2001/0048790 | A1 * | 12/2001 | Burkholder et al. | 385/78 |

FOREIGN PATENT DOCUMENTS

| | | |
|---|---|---|
| EP | 2 128 936 | 12/2009 |
| FR | 2 665 305 | 1/1992 |
| FR | 2 918 216 | 1/2009 |

* cited by examiner

*Primary Examiner* — Tho D Ta

(74) *Attorney, Agent, or Firm* — Oblon, McClelland, Maier & Neustadt, L.L.P.

(57) ABSTRACT

A set of outlets including a sheet and a base adapted for electrical work to each other in a detachable manner, the sheet including at least two electric tracks in a concentric ring configured to respectively cooperate with electrical contacts of an electrical socket. A magnetic mechanism generates a first control force for positioning and holding the sheet on the base. The base includes at least two movable electric contacts movable between a first position inside the base and a second position outside the base to be respectively in direct electrical contact with the electrical tracks, the first force control to move the electrical contacts between the first and the second positions.

8 Claims, 4 Drawing Sheets

ELECTRICAL CONNECTOR ASSEMBLY

TECHNICAL FIELD OF THE INVENTION

The invention relates to an assembly comprising a plug sockets and a power socket adapted to cooperate with each other removably. Said plug comprises at least two concentric annular electrical tracks intended to come respectively cooperate with the electrical contacts of the electric socket. Magnetic control means generates a first control force for positioning and holding the sheet on the base so that the annular tracks are respectively in contact with the electrical contacts of the socket.

STATE OF THE ART

The use of magnetic positioning means of a plug on a power base is known.

Indeed, the document U.S. Pat. No. 7,066,739 describes a set of sockets having a plug and socket respectively having annular electrical tracks intended to come into contact with each other under the action of magnetic means. The use of annular electrical tracks allows an undifferentiated/the blind plug on base angular position.

The magnetic force control means of the set of electrical outlets is sufficient to exert an attraction of the sheet on the base when the latter is positioned in an environment close to the base. In addition, the control force also keeps the plug on the base connected position.

The document EP2128936 also discloses the use of magnetic means for positioning and maintaining a record of an electrical socket. As for the document U.S. Pat. No. 3,521,216, the magnetic means are also adapted to displace the electric contacts of the electric socket so as to ensure an electrical connection between the plug and the base.

To avoid risk of electric shock by direct contact, the electrical tracks the base and/or the plug are generally positioned within grooves of varying depths and more or less close. The presence of these grooves requires an axial positioning face of the plug to the base so that the contacting is easily achievable. More grooves are deep and narrow, more axial positioning must be accurate and binding. This alignment constraint and positioning is particularly felt at the time of separation of the plug. To remedy this problem, the document U.S. Pat. No. 3,521,216 describes a power base where electrical leads are not in grooves. The base includes electrical tracks that are no longer energized when the plug is removed from the base. While the base comprises movable electrical contacts positioned within said base and not accessible. Said electrical contacts are intended to come to connect to the electrical tracks only when the plug is in contact with the base. The risk of electric shock is reduced when the plug is not connected to the base.

However the electrical tracks the base, although not electrically connected are apparent. This may have two drawbacks. On the one hand, it is not recommended by the standards have direct access to electric tracks intended to be energized. On the other hand, in case of malfunction of the mechanism permitting displacement of the movable electrical contacts in a position connected to a non-connected position, the slopes of the base may be turned on while the card is withdrawn.

DISCLOSURE OF THE INVENTION

The invention is therefore to overcome the disadvantages of the prior art, in order to propose a set of sockets adapted to ensure a secure connection between the base and the electrical plug electrical connection.

The base of the set of outlets according to the invention comprising a mobile has at least two electrical contacts movable between a first position inside of the base and a second position outside of said base to be respectively in contact Direct electrical leads with the electrical plug, said first force control means being adapted to move the electrical contacts between the first position and the second position.

According to a development of the invention, the base comprises elastic means for generating a second force command displacement of lower intensity and opposite in direction to the first actuating force, said second biasing force being able to displace the contacts power between the second position and the first position.

According to a development of the invention, the base comprises shutter means adapted to move from a closed position to an open position under the action of the first actuating force to pass the electrical contacts of the first in the second position.

According to one embodiment of the invention, the magnetic control means comprise at least one first magnet integrated in the plug and at least one mobile base integrated magnetic element. The electrical contacts are secured to the magnetic member so that the first actuating force simultaneously moves the movable magnetic element and the electrical contacts between the first position and the second position.

Advantageously, said at least first magnet and said at least one magnetic member are annular.

Advantageously, said at least one magnetic element comprises a magnet.

Advantageously, the concentric annular electrical leads are electrically isolated from each other.

Preferably, the shutter means respectively comprise two sealing flaps, each closure flap being connected to a closing spring.

Preferably, the electrical plug and socket each have an electrical contact to be connected to a grounded outlet.

Preferably, the base comprises contact springs integrally connecting the electrical contacts to the magnetic element.

BRIEF DESCRIPTION OF THE FIGURES

Other advantages and features will become more apparent from the following description of specific embodiments of the invention, given by way of non-limiting example and illustrated in the accompanying drawings in which.

DETAILED DESCRIPTION OF AN EMBODIMENT

Figure 3:
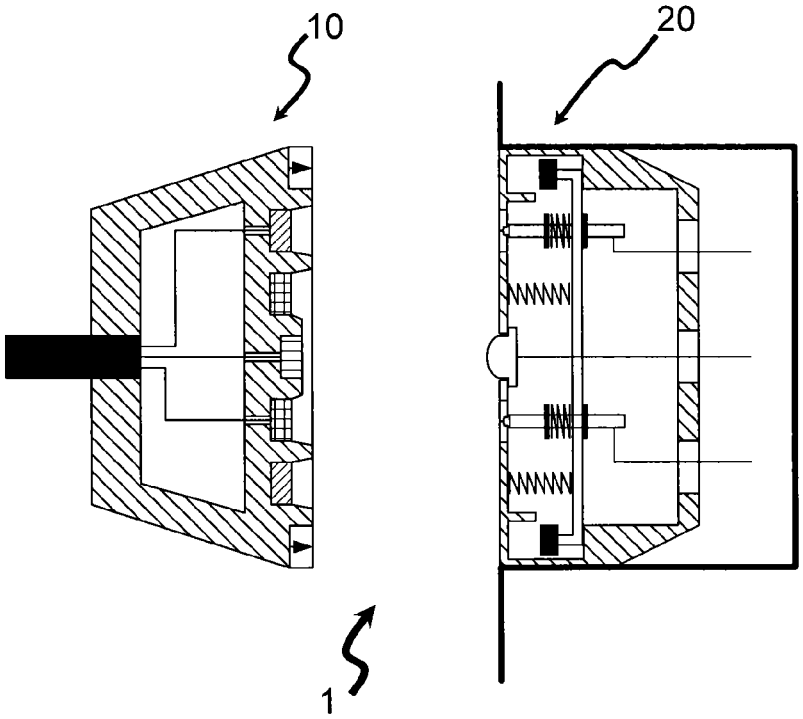
FIG. 3 shows a sectional view of a set of electric taken according to a preferred embodiment of the invention in a first position.
Figure 4:
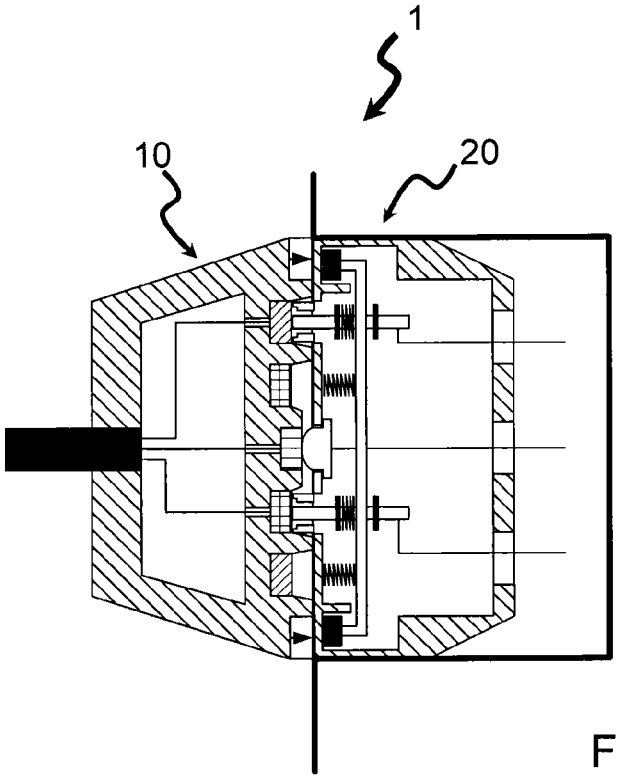
FIG. 4 shows a sectional view of a set of electric taken according to a preferred embodiment of the invention in a second position.

According to a preferred embodiment of embodiment as shown in FIGS. 3 and 4, all electrical outlets 1 including a record 10 and a base 20 power adapted to work with each other so removable.

Figure 1:
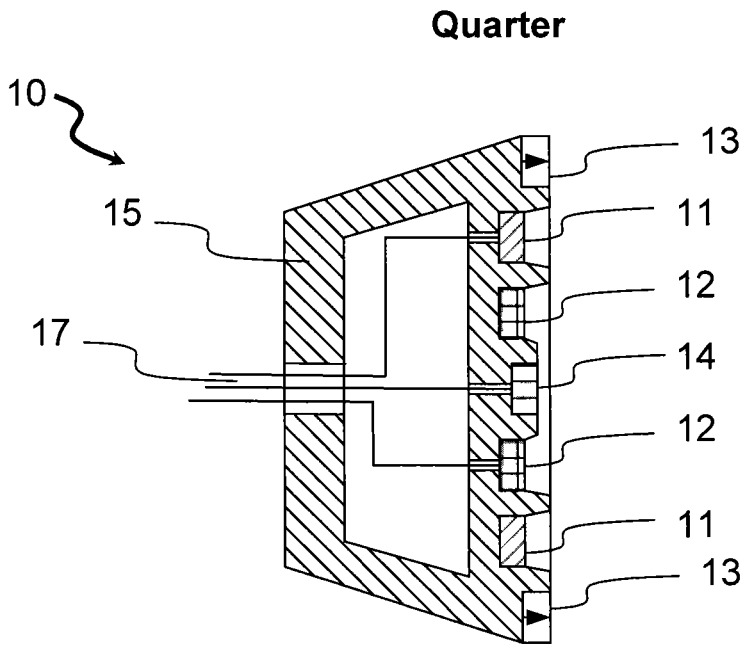
FIG. 1 shows a sectional view of a plug of a set of electric taken according to a preferred embodiment of the invention.
Figure 2:
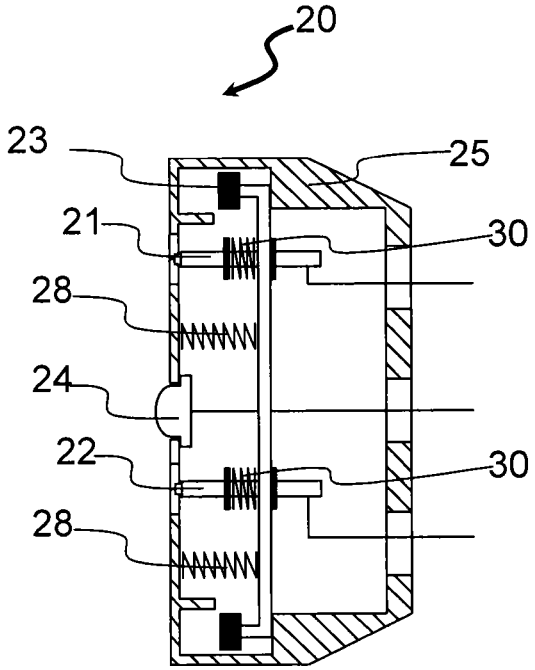
FIG. 2 shows a sectional view of a power base of a set of electric taken according to a preferred embodiment of the invention.

As shown in FIG. 1, said plug 10 comprises a body 15 having at least one substantially planar contact face. As shown in FIG. 2, said electrical base 20 comprises a body 25 having at least one substantially planar contact face. The contact faces of the base 20 and the plug 10 are designed to be placed in contact with each other when said plug is connected to said base (4).

Record 10 includes at least two electrical traces 11, 12 disposed on the contact face of said sheet. Said electrical leads are preferably annular and concentric. Furthermore, said tracks are electrically insulated from each other.

The electrical leads 11, 12 are connected to electrical son and 17 respectively are intended to be working with electrical contacts 21, 22 of the electric base 20.

The plug 10 preferably includes an electric contact 14 for connection to a ground. This electrical ground contact 14 is positioned in the center of the two tracks 11, 12 concentric annular.

The electrical assembly 1 has taken control of the magnetic means 13, 23 generating a first control force for positioning and holding the sheet 10 on the base 20 so that the annular tracks 11, 12 are respectively in contact with the electrical contacts 21, 22 of the base 20.

In one development, magnetic control means 13, 23 have at least one first magnet 13 embedded in the plug 10 and at least one mobile 23 integrated in a housing 25 of the base 20 magnetic element.

According to one particular embodiment, the at least one movable magnetic element 23 has a metal ring made of a magnetic material.

In a second particular embodiment, the at least one movable magnetic element 23 has a magnetic field preferably having an annular shape. In this second special world of embodiment, the first control force is increased relative to that obtained in the first particular embodiment.

When the plug is placed next to the base, the magnetic element 23 and the magnet 13 are attracted to each other causing a sudden positioning and maintaining record 10 on the base 20. Said at least first magnet 13 and the at least one magnetic element 23 is preferably annular in shape. In addition, they are disposed on the periphery of the contact surfaces of the plug and the socket so that the first control force is better distributed to improve the accuracy and efficiency of positioning and maintaining the record of 10 the base 20.

The base 20 includes at least two electrical contacts 21, 22 to be connected to electrical son not shown. The electrical contacts 21, 22 are secured to the magnetic member 23 disposed within housing 25 of base 20. Said at least two electrical contacts 21, 22 are mobile and can move simultaneously with the magnetic member 23 between a first position inside the base 20 and a second position outside of the base to be in direct electrical contact respectively with electrical leads 11, 12 of the 10 electric plug. According to a particular embodiment, the flat contact surface of the base 20 has openings 27 through which the electrical contacts can pass.

The electrical base 20 preferably comprises an electric contact 24 for connection to a ground. Said electric ground contact 24 is preferably positioned at the center of the contact surface of the base for contact with the electrical earth contact 14 of the plug 10.

As shown in FIG. 3, the electrical contacts arranged in a first operating position, are set back relative to the contact surface of the base. The first control force has no effect on the positioning of electrical contacts for the plug 10 is removed from the base 20. The electrical contacts 21, 22 are maintained in this position within the housing 25 of the base by resilient control means 28 generates a second force control. According to one embodiment of the invention, the spring 28 has a spring. The second actuating force is of lower intensity and opposite in direction to the first actuating force.

When the plug 10 toward and engages the base 20, the intensity of the first control force becomes larger than that of the second biasing force. Thus, the first shift force directly acts on the magnetic member 23 and causes it to move from the first to the second position. The electrical contacts 21, 22 is then observed movement between the first position and the second position. Said first actuating force is thus able to move the electrical contacts 21, 22 between the first position and the second position.

If the plug is removed, then the first shift force becomes smaller than the second displacement force which is adapted to move the electrical contacts 21, 22 between the second position and the first position.

According to one embodiment of the invention, the base 20 of the electrical plug assembly 1 comprises closure means 26. Said shutter means are positioned before the apertures 27 through which electrical contacts can pass. In addition, shutter means 26 are adapted to move from a closed position to an open position under the action of the first actuating force to pass the electrical contacts 21, 22 of the first to the second position. According to this embodiment, the opening of the valve means 26 is preferably caused by a surge of electrical contacts 21, 22 of the shutter means 26. When the electrical contacts 21, 22 move from the first to the second position under the action of the first actuating force, they tend to move the valve means 26 to pass through the apertures 27.

Advantageously, the blocking means 26 are returned to a closed position under the action of force generated by the closing springs 29.

Figure 5:
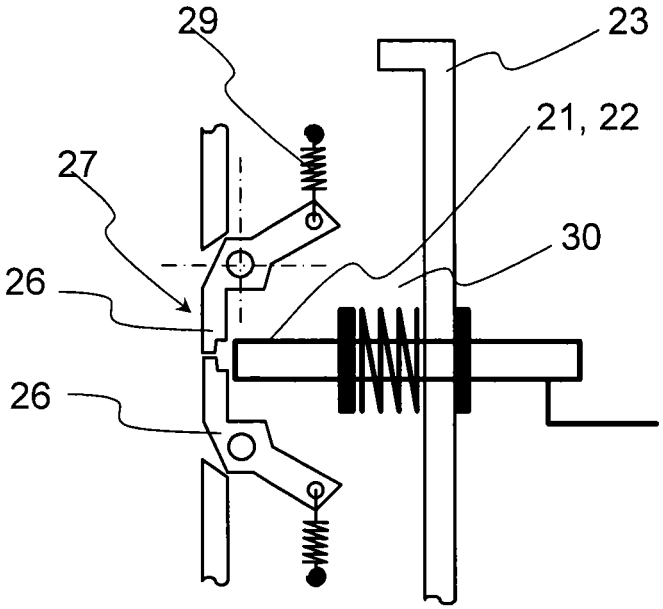
FIGS. 5 and 6 are sectional views of retail electric base according to FIG. 2.
Figure 6:
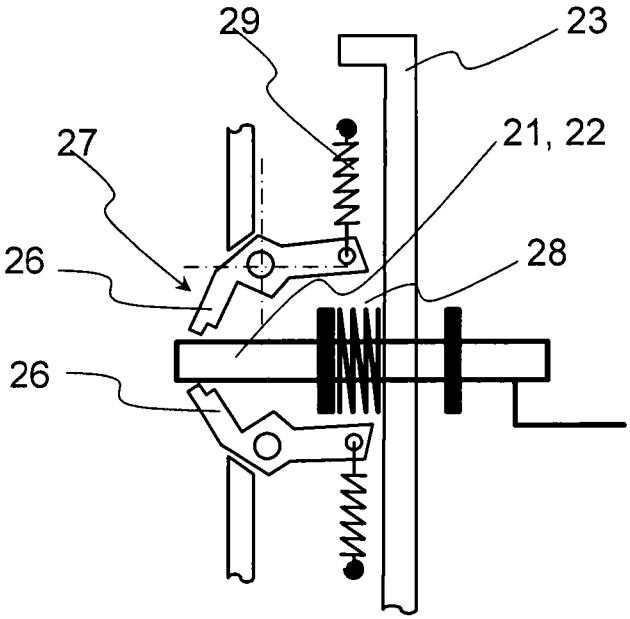
Figure 7:
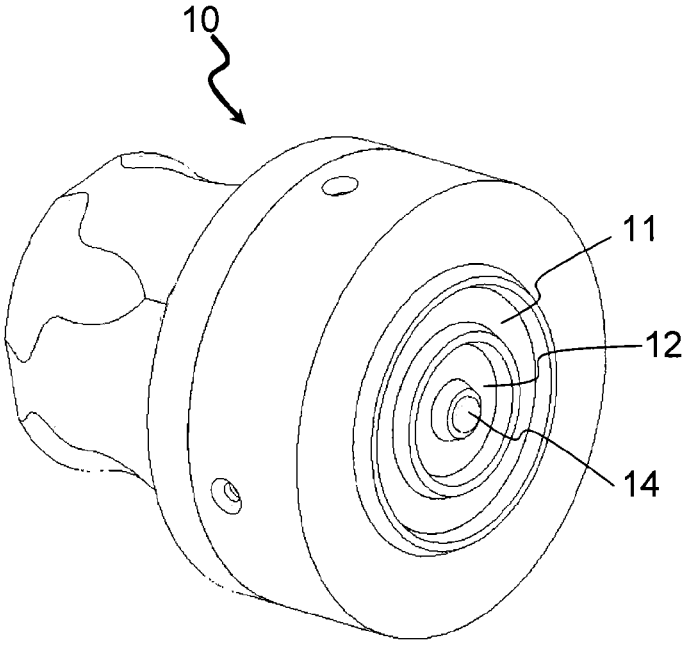
FIGS. 7 and 8 is a perspective view of a set of electric taken according to a preferred embodiment of the invention.
Figure 8:
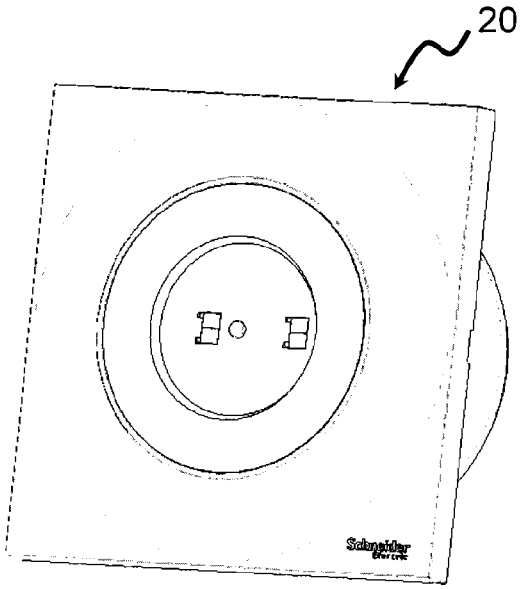

According to a particular embodiment as shown in FIGS. 5 and 6, the closure means 26 of each opening has two components respectively shutters. Each shutter plate is then connected to a closing spring 29.

According to one embodiment, the base 20 has contact springs 30. In practice, each electrical contact is fixedly connected to the magnetic element 23 by a pressure spring contact 3. Said springs are used to ensure that the contact pressure between each electric contact 21, 22 and a power track 11, 12 is sufficient for the passage of electric current between the base 20 and the plug 10.

The invention claimed is:

1. A set of outlets comprising:

an electrical plug and an electrical socket adapted for electrical work are configured to be connected to each other in a detachable manner;

the electrical plug including at least two concentric electrical tracks configured to respectively annularly cooperate with at least two movable electrical contacts of the electrical socket;

magnetic means generating a first control force for positioning and holding the electrical plug on the electrical socket so that the at least two concentric electrical tracks are respectively in contact with the electrical contacts of the electrical socket;

the at least two movable electrical contacts of the electrical socket are movable between a first position inside the electrical socket and a second position such that end surfaces of the at least two movable electrical contacts extend beyond an outside side surface of the electrical socket that contacts the electrical plug, the at least two movable electrical contacts are configured to be respectively in direct electrical contact with the electrical tracks of the electrical plug, the first control force being capable of moving the electrical contacts between the first position and the second position; and shutter means to move from a closed position to an open position under action of the first control force to pass the electrical contacts from the first position to the second position, the shutter means being pushed to the open position by contact with the electrical contacts as the electrical contacts move from the first position to the second position, wherein the shutter means respectively comprises two sealing flaps, each sealing flap being connected to a closing spring.

2. A set of outlets according to claim 1, wherein the electrical socket comprises elastic means generating a second biasing force displacement of lower intensity and opposite in direction to the first control force, the second biasing force to displace the electrical contacts between the second position and the first position.

3. A set of outlets according to claim 1, wherein the at least two concentric electrical tracks are electrically insulated from each other.

4. A set of outlets according to claim 1, wherein the electrical plug and the electrical socket respectively comprise an electrical power contact for connection to a ground.

5. A set of outlets according to claim 1, wherein the magnetic means comprises:

at least a first magnet integrated in the electrical plug and at least one movable magnetic member integral with the electrical socket; and electrical contacts secured to the magnetic member so that the first control force simultaneously moves the movable magnetic member and electrical contacts between the second position and the first position.

6. A set of outlets according to claim 5, wherein the electrical socket includes contact springs integrally connecting the electrical contacts to the magnetic member.

7. A set of outlets according to claim 5, wherein the at least first magnet and the at least one magnetic member are annular.

8. A set of outlets according to claim 7, wherein the at least one magnetic member comprises a magnet.

* * * * *